US005127459A

United States Patent [19]

Markowitz

[11] Patent Number: 5,127,459

[45] Date of Patent: Jul. 7, 1992

[54] ADJUSTABLE ROD FOR TEAR-AWAY ADJUSTABLE WINDOW SHADES

[76] Inventor: Steven L. Markowitz, 719 Greenwich St. No. 2 S, New York, N.Y. 10014

[21] Appl. No.: 743,889

[22] Filed: Aug. 12, 1991

[51] Int. Cl.[5] ..... A47H 1/00

[52] U.S. Cl. ..... 160/263; 211/105.3; 160/238

[58] Field of Search ..... 160/263, 182, 238; 211/105.3; 446/120, 121

[56] References Cited

U.S. PATENT DOCUMENTS

| | | | |
|---|---|---|---|
| 4,102,384 | 7/1978 | Gossling et al. | 160/263 |
| 4,102,385 | 7/1978 | Miller | 160/263 |
| 4,157,108 | 6/1979 | Donofrio | 160/263 |
| 4,232,473 | 11/1980 | Jenkins | 446/124 X |
| 4,438,799 | 3/1984 | Comeau | 160/263 |
| 4,539,239 | 9/1985 | Graves et al. | 160/263 X |
| 4,566,517 | 1/1986 | Simon | 160/263 |

FOREIGN PATENT DOCUMENTS

| | | | |
|---|---|---|---|
| 78326 | 4/1915 | Fed. Rep. of Germany | 160/263 |

*Primary Examiner*—Blair M. Johnson

*Attorney, Agent, or Firm*—Kenyon & Kenyon

[57] ABSTRACT

The present invention provides a readily adjustable rod for a tear-away window shade. The shade is constructed of a long sheet of a rollable material provided with a multiplicity of longitudinally disposed parallel tear lines spaced apart from each other in the widthwise direction to define a multiplicity of strips. The window shade rod includes a multiplicity of disconnectable segments. Strips of the sheet can be individually torn away at the tear lines from the ends of the sheet so as to decrease the width of the shade in decrements corresponding to the width of the strips. Segments can be removed from the rod so that the rod width can be decreased to correspond to the width of the sheet.

13 Claims, 3 Drawing Sheets

ADJUSTABLE ROD FOR TEAR-AWAY ADJUSTABLE WINDOW SHADES

BACKGROUND OF THE INVENTION

1. Field of the Invention

The invention relates generally to window shades whose width can be adjusted by the user to fit windows of various sizes. More particularly, the invention relates to a window shade rod which is well suited for use with adjustable window shades.

2. Description of Related Art

It is known that windows come in various sizes and shapes. In the case of window shades, the shade is typically manufactured sufficiently long in the vertical direction and is wound on a spool or roll bar having an adjustable stop mechanism so that the purchaser can cover windows of various lengths in the vertical direction. However, these shades are not adjustable in the horizontal widthwise direction.

Accordingly, it has been necessary for manufacturers of window shades to provide shades of several different widths to accommodate various types of windows. Alternatively, windows shades can be custom made by the manufacturer according to particular window dimensions. However, this can be a time consuming process, particularly in the case of homes containing a variety of different window dimensions. In addition, in the event of inaccurate measurements the shades must be returned to the manufacturer for recutting, if possible.

U.S. Pat. No. 4,539,238 addressed the need for window shades which can be manufactured in a single standard size and adjusted by the consumer in the home to fit windows of varying dimensions. This patent describes a tear-away window shade having a multiplicity of elongate fabric strips of substantially equal length disposed laterally adjacent to each other in substantially the same plane. A multiplicity of fibers or threads are provided for forming at least one tying link between each pair of adjacent fabric strips to hold the same substantially in contact with one another in the plane of the window shade. The tying fibers or threads are severable upon the manual application of a force exceeding a predetermined threshold, thereby enabling the disengagement and separation of adjacent fabric strips from one another. The window shade rod takes the form of a pair of telescoping cylinders which are screwably connected to one another for modifying the length of the rod upon adjustment in the width of the window shade.

SUMMARY OF THE INVENTION

The present invention provides an improved readily adjustable rod for a tear-away window shade. The shade can be constructed of a long sheet of a rollable material, such as cloth, paper or plastic, wound around a spool or rod. The sheet of material is provided with a multiplicity of longitudinally disposed parallel tear lines spaced apart from each other in the widthwise direction to define a multiplicity of strips. Strips of the sheet can be individually torn away at the tear lines from the ends of the sheet so as to decrease the width of the shade in decrements corresponding to the width of the strips.

The rod of the invention has at least a portion thereof divided into a multiplicity of connectable segments so that the width of the rod can be adjusted by connecting or removing segments The width of the individual removable segments can match the width of the strips of the sheet so that the width of the rod can be adjusted to match decreases in the width of the window shade. The bottom or free end of the sheet of material is preferably attached to a support rail to avoid wrinkling and to facilitate pulling and unwinding the sheet from the spool The support rail is segmented in the same manner as the rod so that its width is also adjustable to match the window shade width.

DETAILED DESCRIPTION OF THE INVENTION

Figure 1:
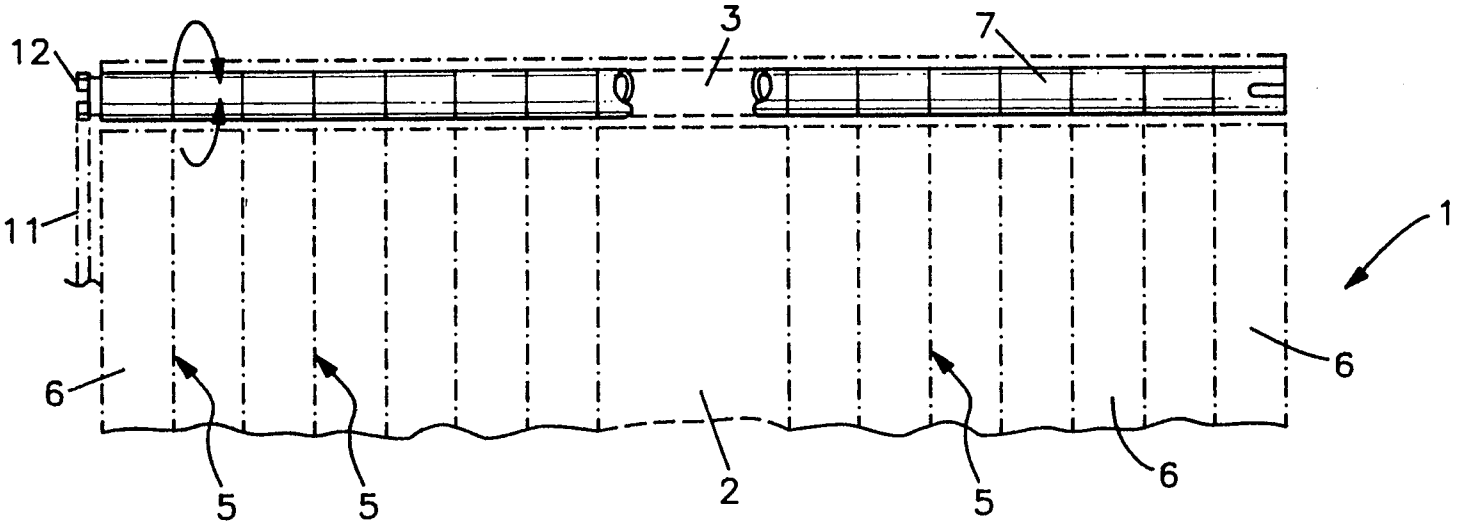
FIG. 1 is a perspective view of a tear away window shade and window shade rod in accordance with the invention.

Referring to FIGS. 1 and IA, a window shade in accordance with the invention is generally illustrated at 1. The shade 1 includes an elongated sheet of a substantially flat rollable material 2 a portion of which is wound around a rod 3. Sheet 2 can be made of any material from which shades or curtains are ordinarily made such as cloth, linen, paper and plastics and the like. As known in the art, one edge of sheet 2 is permanently associated with rod 3. The other edge of sheet 2, which shall be referred to as the free end, is typically provided with a support rail 4 across the width of the shade to facilitate pulling and unwrapping of the shade without wrinkling. The free end of the sheet 2 can be wrapped around support rail 4 and stitched so as to conceal the rail from view. A ring may or other means 10 be provided on the rail to further facilitate pulling of the shade.

Figure 3:
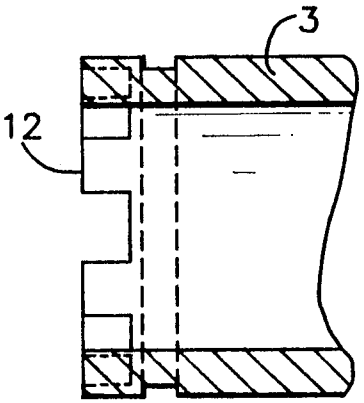
FIG. 3 is a detailed view of the sprocket end of the rod.
Figure 2:
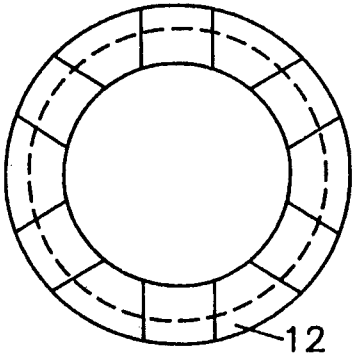
FIG. 2 is an end view of the window shade rod depicting the sprocket end of the rod.

As known in the art, the sheet 2 is elongated in the vertical direction so that it is long enough to cover windows of various heights. To adjust the length of the shade the free end of the sheet 2 is pulled away from the rod until the desired length is achieved. For adjustment purposes, the shade may be provided with a conventional adjustment-stop mechanism used in shades or vertical blinds. For example, a ball chain 11 may be used in conjunction with a sprocket assembly 12 provided on an end of rod 3 (see FIGS. 2 and 3).

Sheet 2 of the shade of the invention is provided with a multiplicity of parallel separation or tear lines 5 which are disposed in the longitudinal direction. Preferably, the tear lines are subtle lines of perforation which are evenly spaced about one inch or less apart across the width of the shade so as to define a multiplicity of strips 6. In this way, the width of the shade can be adjusted by tearing away individual or multiple strips 6 from an end of the shade until the desired width is achieved. A relatively precise fit can be achieved when tear lines are spaced about less than one inch apart such that each strip is about 0.75 inches wide. Such dimensions allow for adjustment in 0.375 inch decrements on each side of the shade.

Preferably, sheet 2 is constructed in accordance with my U.S. Pat. No. 4,539,238 which is incorporated herein by reference.

Figure 6:
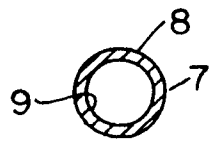
FIG. 6 is an end view of an individual rod segment.

The width of rod 3 is also adjustable so that it can be adjusted to fit the width of the window. The present invention employs the novel adjustable rod 3 illustrated in FIG. 4. At least a portion of rod 3 is formed from a multiplicity of removable mating segments 7. Each segment 7 is formed from a pair of tubular members 8, 9 which can be cylinders of different diameters (see FIGS. 4–6). One end of tubular member 9 is fixedly received within one end of tubular member 8. In this way, tubular members 8 and 9 are coaxial but staggered in the longitudinal direction so that the opposite end of tubular member 9 is disposed outside of tubular member 8. The portion of tubular member 9 disposed outside of tubular member 8 will be referred to as the free end of member 9. The opposite end of the segment 7 is a hollow open end of tubular member 8 which is referred to as the free end of member 8.

Figure 5:
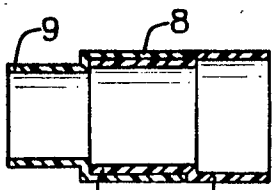
FIG. 5 is a detailed cross-sectional view of two segments of the shade rod connected.
Figure 4:
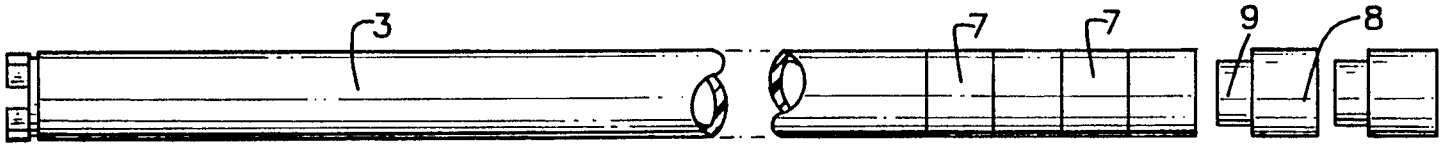
FIG. 4 is a detailed view of the window shade rod showing individual connectable segments thereof.
Figure 1A:
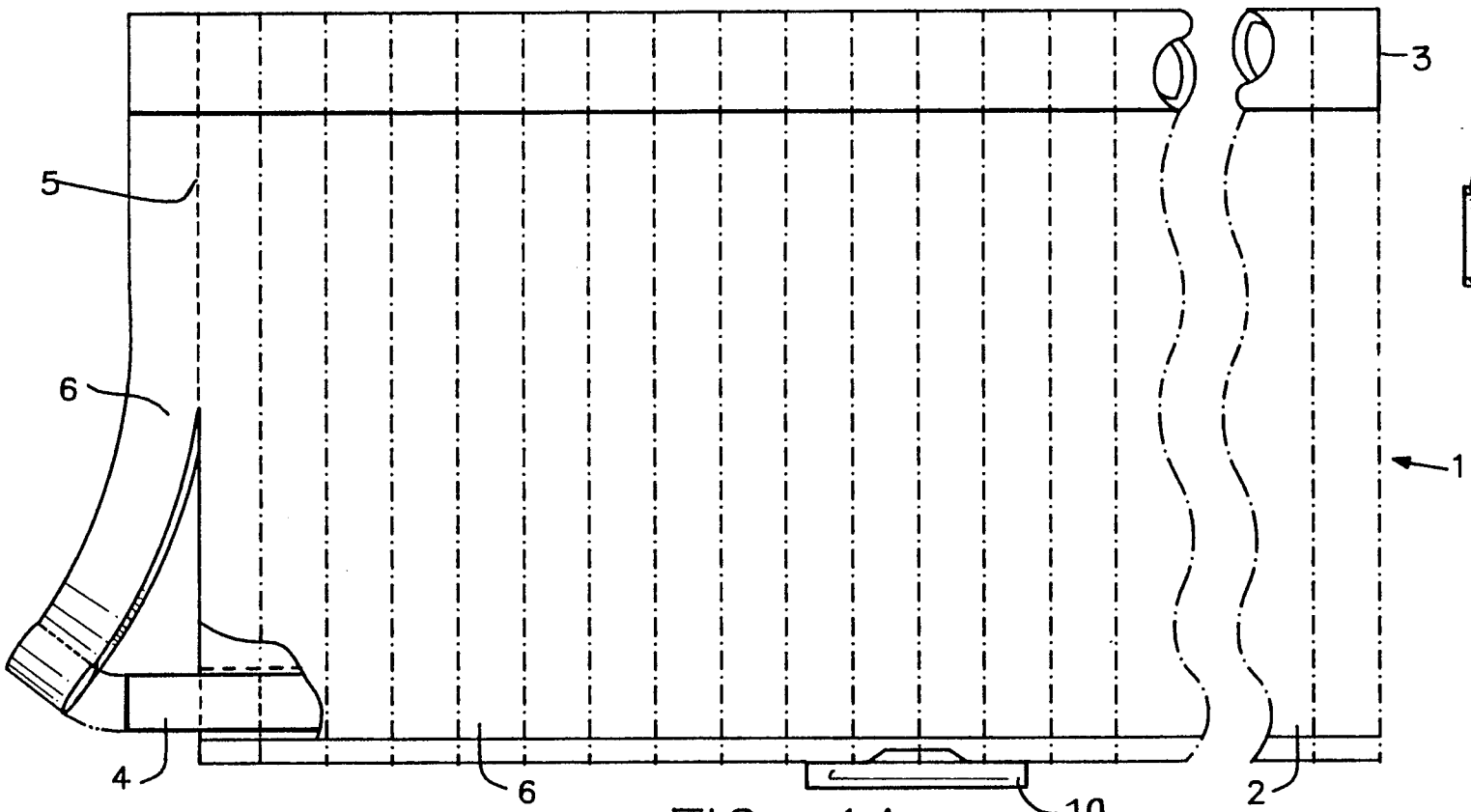
FIG. 1A is a perspective view of the window shade of FIG. 1 showing a strip of the shade being torn away and the support rail.

Segments 7 are connectable in end to end fashion to form a single continuous rod 3 (see FIGS. 4 and 5). The free end of tubular member 9 of one segment 7 is mated with the free end of tubular member 8 of a second segment 7 by inserting the free end of member 9 into the free end of member 8. Preferably, the diameters of members 8 and 9 are such that member 8 of one segment snugly receives member 9 of an adjoining segment so that adjoining segments 7 are not easily separated. For this purpose the segments are preferably constructed of a rigid plastic such as polyvinyl chloride.

It can be seen that when the segments 7 are of uniform dimensions, tubular members 8 of adjoining segments 7 will abut to form a continuous outer surface of spool 3 and tubular members 9 will abut to form a continuous inner surface of spool 3. Preferably, the length of each tubular member 8 matches the width of each strip 6 of the shade so that the length of the spool 3 can be adjusted to correspond to adjustments to the width of the sheet 2. In this way, for each strip 6 which is torn away, one segment 7 is removed from rod 3.

Figure 7:
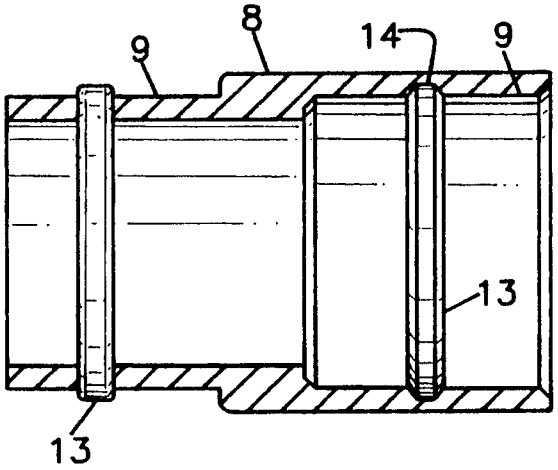
FIG. 7 is a detailed view of another embodiment of the rod segment in accordance with the invention.

In a preferred embodiment, tubular member 9 of each segment 7 is provided with an outwardly depending rib 13 which is adapted to interlock with a channel 14 defined in the inner surface of tubular member 8 of an adjoining segment 7 (see FIG. 7). In this embodiment, the segments 7 can be constructed of a flexible-resilient material like polyvinylchloride so that rib 13 can snap it into channel 14 of another segment. The segments of this embodiment of the invention interlock particularly well when assembled.

Likewise, the support rail 4 is adjustable so that it can be made to conform to the width of the window and the sheet 2. At least a portion of the rail can be divided into removable segments as described above with respect to rod 3.

It may be desirable to have support rail 4 flat rather than cylindrical so that it can be easily concealed from view by the free end of sheet 2. It should be appreciated that the segments of rail 4 need not be cylindrical as illustrated with respect to rod 3. Segments may be flat or bar like so long as they are provided with mating ends so that they may be joined in end to end fashion.

Since the shades of the present invention are readily fittable by the consumer to windows of various dimensions, the manufacturer need only supply the shades in one standard size A wide variety of different fabrics and patterns can therefore be made available. The longitudinally disposed tear lines are aesthetically appealing and blend particularly well with a wide variety of patterns.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings accordingly to be regarded in an illustrative rather than a restrictive sense.

What is claimed is:

1. A window shade having an adjustable width which can be readily fitted to windows of various sizes comprising:

a single rod, without a telescoping cylinder, comprising a multiplicity of disconnectable rod segments forming at least a portion of the rod, wherein each rod segment is a tubular member having an open end and a projection end, the open end being adapted to mate with the projection end of an adjoining rod segment to form a portion of the rod;

a sheet of a rollable material having a first edge belonging to the rod and an opposite free second edge, said sheet capable of being collected around the rod from said first edge, and said sheet being separable into a multiplicity of strips along a multiplicity of substantially parallel tear lines extending from the second free edge of the sheet toward the first edge, wherein a plurality of the rod segment are of uniform dimensions such that the width of the rod can be adjusted to correspond to reductions in the width of the sheet as individual strips are torn away by disconnecting individual ones of said plurality of rod segments.

2. The window shade according to claim 1 wherein said tear lines are evenly distributed across the sheet so that the sheet is separable along said tea lines into a multiplicity of strips of equal width.

3. The window shade according to claim 2 wherein said tear lines are distributed so that the sheet is separable into a multiplicity of strips having a uniform width of between about 0.25 inches to about 2 inches.

4. The window shade according to claim 1 wherein the tubular member is a hollow cylinder having a certain inner diameter and wherein the projection end is a coaxially disposed cylinder having an outer diameter about equal to said inner diameter.

5. The window shade according to claim 1 wherein a support rail having a means for varying the width thereof is attached along the entirety of the second edge of the sheet.

6. The window shade according to claim 5 wherein the means for varying the width of the support rail includes a plurality of disconnectable rail segments.

7. The window shade according to claim 2 wherein a plurality of the rod segments are of uniform dimensions such that the width of the rod can be adjusted to correspond to reductions in the width of the sheet as individual strips are torn away by disconnecting individual ones of said plurality of rod segments.

8. The window shade according to claim 3 wherein a plural of the rod segments are of uniform dimensions such that the width of the rod can be adjusted to correspond to reductions in the width of the sheet as individual strips are torn away by disconnecting individual ones of said plurality of rod segments.

9. The window shade according to claim 4 wherein a plurality of the rod segments are of uniform dimensions such that the width of the rod can be adjusted to correspond to reductions in the width of the sheet as individual strips are torn away by disconnecting individual ones of said plurality of rod segments.

10. The window shade according to claim 1 wherein the projection end is provided with an outwardly depending rib and the open end is provided with an inwardly depending channel, said rib and channel being adapted such that the rib of a rod segment can be snap fit into the channel of an adjoining rod segment when the rod segments mate.

11. The window shade according to claim 4 wherein the projection end is provided with an outwardly depending rib and the open end is provided with an inwardly depending channel, said rib and channel being adapted such that the rib of a rod segment can be snap fit into the channel of an adjoining rod segment when the rod segments mate.

12. An adjustable window shade rod in use with a tear-away window shade, the window shade including a multiplicity of elongate fabric strips of substantially equal length disposed laterally adjacent to each other and being severable from each other upon the manual application of a force exceeding a predetermined threshold, the window shade rod comprising a single rod, without a telescoping cylinder, having a multiplicity of disconnectable rod segments forming at least a portion of the rod, each rod segment being a tubular member having an open end and a projection end, the open end being adapted to mate with the projection end of an adjoining rod segment to form a portion of the rod, wherein the tubular member is a hollow cylinder having a certain inner diameter and wherein the projection end is a coaxially disposed cylinder having an outer diameter about equal to said inner diameter.

13. The adjustable window shade rod according to claim 12 wherein the projection end is provided with an outwardly depending rib and the open end is provided with an inwardly depending channel, said rib and channel being adapted such that the rib of a rod segment can be snap fit into the channel of an adjoining rod segment when the rod segments mate.

* * * * *